US008447199B2

(12) United States Patent
Ueno et al.

(10) Patent No.: US 8,447,199 B2
(45) Date of Patent: May 21, 2013

(54) FIXING DEVICE AND IMAGE FORMING APPARATUS INCLUDING SAME

(75) Inventors: Satoshi Ueno, Komae (JP); Masanao Ehara, Zama (JP); Tadashi Ogawa, Machida (JP); Hiroshi Seo, Sagamihara (JP); Takahiro Imada, Yokohama (JP); Takamasa Hase, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 292 days.

(21) Appl. No.: 12/861,255

(22) Filed: Aug. 23, 2010

(65) Prior Publication Data

US 2011/0052277 A1 Mar. 3, 2011

(30) Foreign Application Priority Data

Aug. 26, 2009 (JP) ..... 2009-195213

(51) Int. Cl.
*G03G 15/20* (2006.01)

(52) U.S. Cl.
USPC ..... 399/67; 399/330

(58) Field of Classification Search
USPC ..... 399/67, 330, 331
See application file for complete search history.

(56) References Cited

U.S. PATENT DOCUMENTS

| | | | |
|---|---|---|---|
| 3,973,845 | A | 8/1976 | Lindblad et al. |
| 5,832,354 | A | 11/1998 | Kouno et al. |
| 5,915,147 | A | 6/1999 | Kouno et al. |
| 6,219,520 | B1 | 4/2001 | Ehara |
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,785,505 | B2 | 8/2004 | Yasui et al. |
| 6,807,386 | B2 | 10/2004 | Yasui et al. |
| 6,881,927 | B2 | 4/2005 | Yoshinaga et al. |
| 6,892,044 | B2 | 5/2005 | Yasui et al. |
| 7,022,944 | B2 | 4/2006 | Yoshinaga et al. |
| 7,266,336 | B2 | 9/2007 | Ueno et al. |
| 7,450,872 | B2 | 11/2008 | Ueno et al. |
| 7,491,917 | B2 | 2/2009 | Ueno |
| 7,509,085 | B2 | 3/2009 | Yoshinaga et al. |
| 7,546,049 | B2 | 6/2009 | Ehara et al. |
| 7,693,439 | B2 | 4/2010 | Seo et al. |

(Continued)

FOREIGN PATENT DOCUMENTS

| | | |
|---|---|---|
| JP | 51-109739 | 9/1976 |
| JP | 2516886 | 4/1996 |
| JP | 2673959 | 7/1997 |
| JP | 2008-102409 | 5/2008 |

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

A fixing device for fixing an unfixed toner image on a recording medium includes a fixing member, a pressure member, a sheet guide, and a pressure adjusting mechanism. The fixing member heats the unfixed toner image on the recording medium. The pressure member is disposed opposite the fixing member and presses against the fixing member to define a fixing nip through which the recording medium bearing the unfixed toner image passes to fix the unfixed toner image onto the recording medium. The position of the fixing nip is changeable. The sheet guide disposed adjacent to the pressure member guides the recording medium to the fixing nip and moves in conjunction with movement of the pressure member. The pressure adjusting mechanism operatively connected to the pressure member adjusts an amount of engagement of the pressure member relative to the fixing member. An image forming apparatus includes the fixing device.

10 Claims, 5 Drawing Sheets

U.S. PATENT DOCUMENTS

| | | | | |
|---|---|---|---|---|
| 7,715,774 | B2 | 5/2010 | Ueno | |
| 7,734,208 | B2 | 6/2010 | Seo et al. | |
| 7,742,714 | B2 | 6/2010 | Shinshi et al. | |
| 2002/0001476 | A1* | 1/2002 | Nagamine et al. | 399/45 |
| 2006/0029411 | A1 | 2/2006 | Ishii et al. | |
| 2006/0257183 | A1 | 11/2006 | Ehara et al. | |
| 2007/0003334 | A1 | 1/2007 | Shinshi et al. | |
| 2007/0014600 | A1 | 1/2007 | Ishii et al. | |
| 2007/0212089 | A1 | 9/2007 | Seo et al. | |
| 2007/0242988 | A1 | 10/2007 | Seo et al. | |
| 2007/0280754 | A1 | 12/2007 | Ogawa et al. | |
| 2008/0025772 | A1 | 1/2008 | Seo et al. | |
| 2008/0025773 | A1 | 1/2008 | Ito et al. | |
| 2008/0063443 | A1 | 3/2008 | Yoshinaga et al. | |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2008/0317532 | A1 | 12/2008 | Ehara et al. | |
| 2009/0060550 | A1 | 3/2009 | Seo | |
| 2009/0123201 | A1 | 5/2009 | Ehara et al. | |
| 2009/0148204 | A1 | 6/2009 | Yoshinaga et al. | |
| 2009/0148205 | A1 | 6/2009 | Seo et al. | |
| 2009/0245897 | A1 | 10/2009 | Seo et al. | |
| 2010/0303521 | A1 | 12/2010 | Ogawa et al. | |
| 2011/0026988 | A1 | 2/2011 | Yoshikawa et al. | |

* cited by examiner

FIXING DEVICE AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application No. 2009-195213, filed on Aug. 26, 2009 in the Japan Patent Office, which is hereby incorporated herein by reference in its entirety.

BACKGROUND OF THE INVENTION

1. Field of the Invention

Exemplary aspects of the present invention generally relates to a fixing device and an image forming apparatus incorporating the same, and more particularly, to a fixing device employing a pressure adjustment mechanism that adjusts pressure of a pressure roller against a fixing roller, and an image forming apparatus incorporating the fixing device.

2. Description of the Background Art

There is increasing demand for energy-efficient, high-productivity image forming apparatuses such as printers, copiers, facsimile machines, and multifunctional machines including at least two of these functions. In order to accommodate such conflicting demand, typically, optimizing the heating efficiency of a fixing device used in the image forming apparatus, which fixes an unfixed toner image onto a recording medium, is of critical importance.

There are various ways of fixing the unfixed toner image onto the recording medium. For example, the image forming apparatuses can form an unfixed toner image directly or indirectly onto the recording medium, typically a recording sheet or paper including photosensitive paper and electrostatic recording paper, using such image forming methods as electrophotography, electrostatic recording, and magnetic recording. Here, forming the unfixed toner image indirectly on the recording medium means forming the unfixed toner image initially on a transfer member and then transferring it onto the recording medium.

To fix the unfixed toner image on the recording medium, a fixing device using a contact-type fixing method is widely used.

Generally, a known fixing device using a heating roller method is equipped with a hollow heating roller, also known as a fixing roller, and a pressure roller disposed opposite the heating roller. A heat source (e.g., a halogen lamp) is disposed inside the heating roller to heat the heating roller. The heating roller and the pressing roller meet and press against each other, together defining a fixing nip or simply nip therebetween. The recording medium bearing an unfixed toner image is guided into and through the fixing nip, where heat and pressure are applied to the unfixed toner image on the recording medium to fuse and fix the unfixed toner image onto the recording medium.

In order to reliably convey the recording medium bearing the unfixed toner image to the fixing nip, a sheet guide is provided substantially at the beginning of the fixing nip to guide the recording medium in a more stable manner. However, if the sheet guide is not properly shaped or properly positioned, pressure is not applied evenly in the fixing nip, thereby causing undesirable creasing of the recording medium. In particular, in recent image forming apparatuses, the recording medium is most likely to be conveyed upward in the vertical direction (vertical conveyance) during the transfer and fixing processes. The orientation of the recording medium is not stable during the vertical conveyance. Thus, the sheet guide needs to be properly disposed for reliable conveyance.

While reliable conveyance of the recording medium to the fixing nip is a necessity, it contributes only indirectly to meeting consumer demand for energy efficiency and higher productivity. To satisfy at least the latter requirement directly, various methods for shortening rise time, for example, have been proposed. For example, increasing the width of the fixing nip can increase fixing speed and reduce the rise time, thus increasing productivity.

However, although advantageous, this approach has a drawback in that having a wide nip width requires more heat, increasing power consumption. Moreover, the recording medium tends to crease more easily in the wide fixing nip. In addition, if such a nip width is not changeable, it is difficult to obtain a desired fixing nip width in accordance with different types and thicknesses of the recording media sheets.

In view of the above, JP-2008-102409-A proposes to adjust the width of the fixing nip in accordance with the type and thickness of the recording media sheets as well as the heating conditions of the fixing device. In this configuration, the fixing device employs a pressure adjusting mechanism to change the position of the pressure roller to adjust an amount of engagement of the pressure roller against the fixing roller to obtain an optimum nip width.

Although advantageous, there is a drawback in that when the pressure roller is moved to adjust the nip width while the position of the sheet guide is fixed (to a housing of the fixing device or the like), the position of the sheet guide relative to the fixing nip is changed. In other words, the position of the sheet guide does not change with the movement of the pressure roller. As a result, the recording medium is not reliably conveyed to the fixing nip.

In view of the foregoing, a device capable of stably conveying the recording medium even when the position of the pressure roller changes to obtain an optimum nip width is needed, in order to provide an energy-efficient, high-productivity image forming apparatus.

SUMMARY OF THE INVENTION

In view of the foregoing, in one illustrative embodiment of the present invention, a fixing device includes a fixing member, a pressure member, a sheet guide, and a pressure adjusting mechanism. The fixing member heats an unfixed toner image on a recording medium. The pressure member is disposed opposite the fixing member and presses against the fixing member to define a fixing nip through which the recording medium bearing the unfixed toner image passes to fix the unfixed toner image onto the recording medium. The position of the fixing nip is changeable. The sheet guide disposed adjacent to the pressure member guides the recording medium to the fixing nip and moves in conjunction with movement of the pressure member. The pressure adjusting mechanism operatively connected to the pressure member adjusts an amount of engagement of the pressure member relative to the fixing member.

In another illustrative embodiment of the present invention, an image forming apparatus includes an image bearing member, a developing device, a transfer device, and a fixing device. The image bearing member bears an electrostatic latent image on a surface thereof. The developing device develops the electrostatic latent image formed on the image bearing member using toner to form a toner image. The transfer device transfers the toner image on the recording medium. The fixing device fixes the toner image onto the recording medium. The fixing device includes a fixing member, a pressure member, a sheet guide, and a pressure adjusting mechanism. The fixing member heats an unfixed toner image on a recording medium. The pressure member is disposed opposite the fixing member and presses against the fixing member to define a fixing nip through which the recording medium bearing the unfixed toner image passes to fix the unfixed toner image onto the recording medium. The position of the fixing nip is changeable. The sheet guide disposed adjacent to the pressure member guides the recording medium to the fixing nip and moves in conjunction with movement of the pressure member. The pressure adjusting mechanism operatively connected to the pressure member adjusts an amount of engagement of the pressure member relative to the fixing member.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
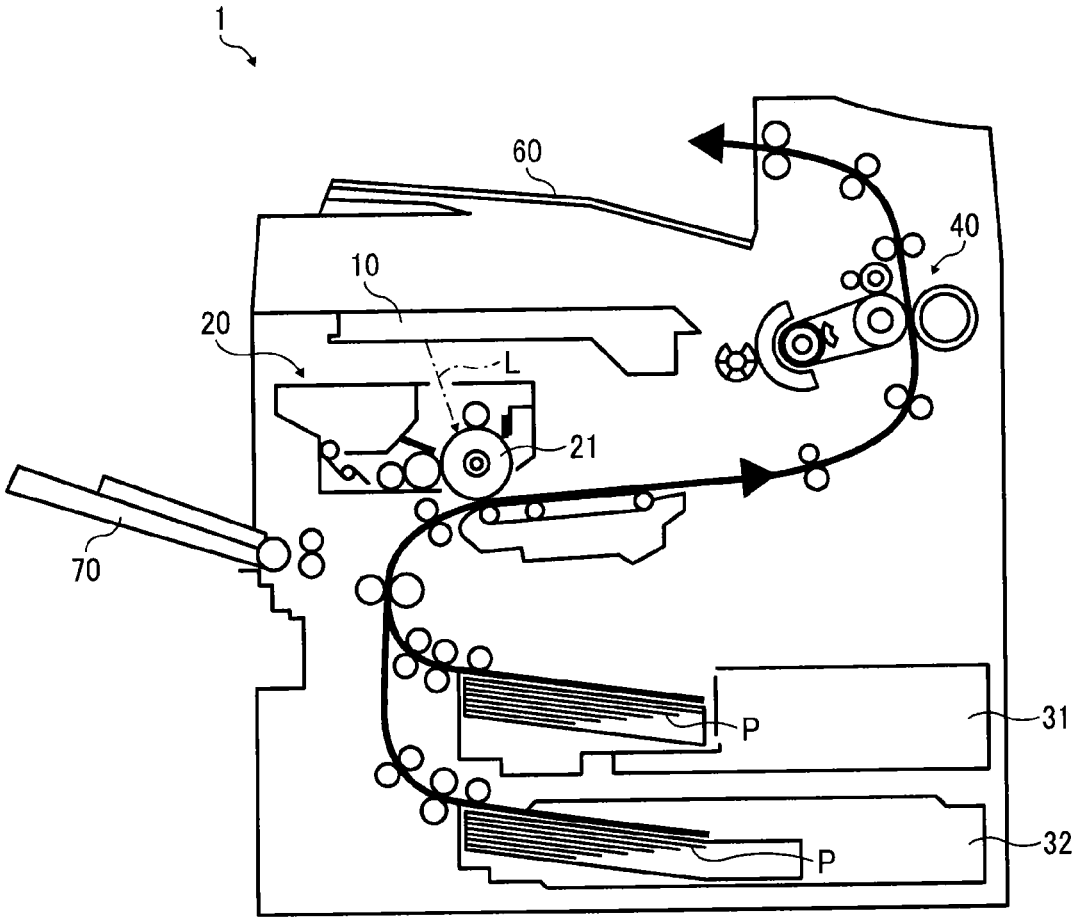
FIG. 1 is a schematic diagram illustrating an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating an image forming apparatus 1 according to the illustrative embodiment of the present invention. As illustrated in FIG. 1, the image forming apparatus 1 include a document reader 10, a transfer device 20 including a photoreceptor drum 21, a first sheet tray 31, a second sheet tray 32, a fixing device 40, a sheet discharge table 60, and a manual feed tray 70. A reference letter "P" refers to a recording medium (recording sheet).

An original document is placed on an upper surface of the document reader 10 of the image forming apparatus 1. The document reader 10 reads optically the original document. Image data of the original document read by the document reader 10 is converted to an optical beam L.

The optical beam L illuminates the photoreceptor drum 21 of the transfer device 20 in accordance with the image data, thereby forming an electrostatic latent image on the photoreceptor drum 21. Subsequently, the electrostatic latent image is developed with toner in a developing device into a visible image, known as a toner image.

In the transfer device 10, the toner image is then transferred onto the recording medium P fed from the first sheet tray 31 or the second sheet tray 32. Subsequently, the recording medium P on which the image is transferred is conveyed to the fixing device 40 in which heat and pressure are applied to the toner image on the recording medium, and the toner image is fixed onto the recording medium. After the fixing process, the recording medium P bearing the fixed image is discharged onto the sheet discharge table 60.

Figure 2A:
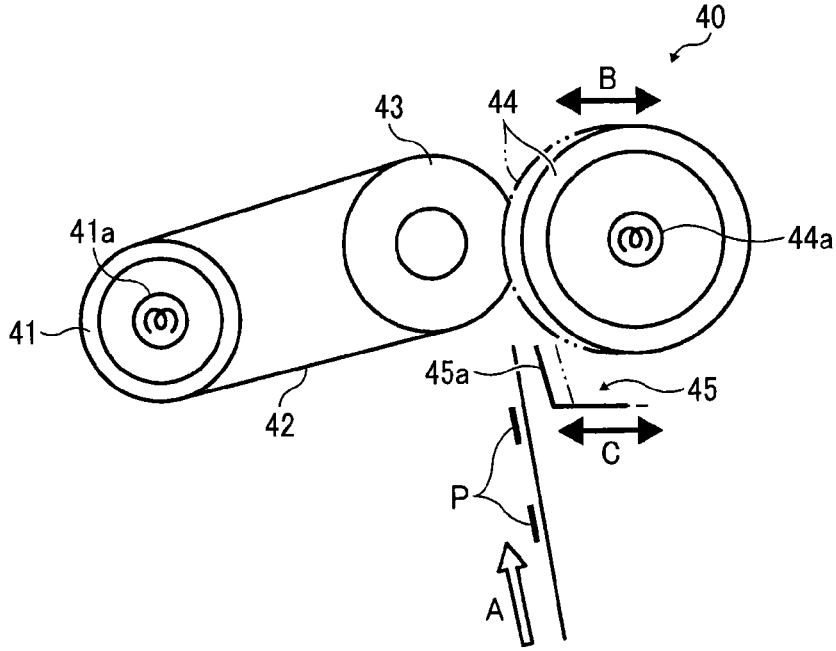
FIG. 2A is a schematic diagram illustrating one example of a fixing device of the image forming apparatus of FIG. 1 according to an illustrative embodiment of the present invention.
Figure 2B:
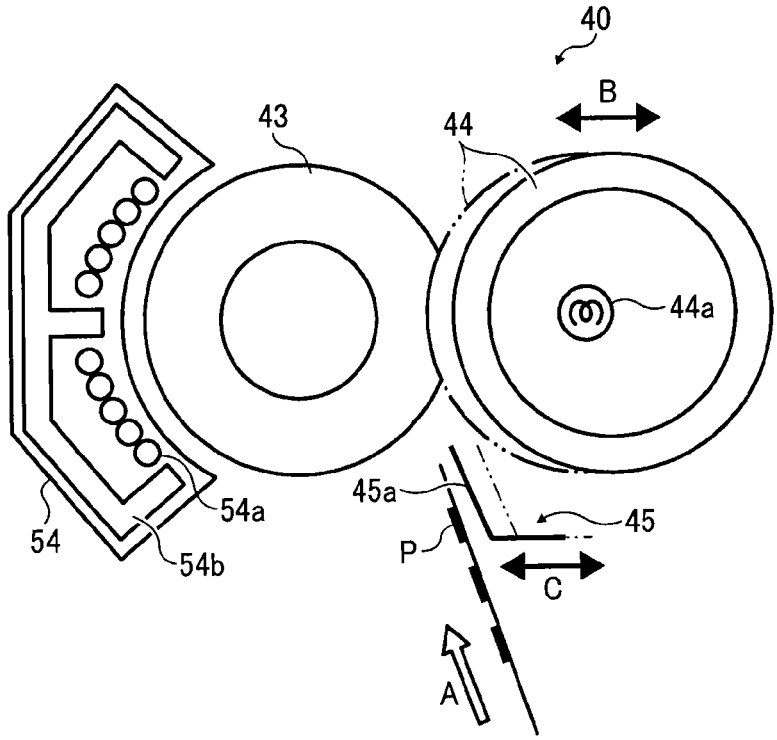
FIG. 2B is a schematic diagram illustrating another example of the fixing device according to an illustrative embodiment of the present invention.

Next, with reference to FIGS. 2A and 2B, a detailed description of the fixing device 40 is provided below. FIG. 2A is a schematic diagram illustrating one example of the fixing device 40 according to the illustrative embodiment. FIG. 2B is a schematic diagram illustrating another example of the fixing device 40 according to the illustrative embodiment.

As illustrated in FIG. 2A, the fixing device 40 includes a heating roller 41, a fixing belt 42, a fixing roller 43, a pressure roller 44, and a sheet guide 45. The fixing device 40 also includes a pressure adjusting mechanism, for example, a pressure-adjusting cam mechanism 50 such as that shown in FIG. 7, that moves the pressure roller 44 in the direction indicated by a double-headed arrow B. The heating roller 41 includes a heater 41*a* inside the hollow of the heating roller 41 and rotates in a counterclockwise direction, causing the fixing roller 43 to rotate through the fixing belt 42 in the counterclockwise direction.

The pressure roller 44 includes a heater 44*a* inside thereof and is disposed opposite the fixing roller 43. The fixing roller 43 and the pressure roller 44 meet and press against each other through the fixing belt 42, thereby defining a fixing nip or simply referred to as a nip. Alternatively, as illustrated in FIG. 2B, the fixing roller 43 may be heated electromagnetically by an electromagnetic heater 54 serving as a heater. The electromagnetic heater 54 disposed in the vicinity of the left side of the fixing roller 43 includes a coil 54*a* and a core 54*b*.

The recording medium P on which an unfixed toner image is formed is conveyed to the fixing nip between the fixing roller 43 and the pressure roller 44 in the direction indicated by an arrow A.

The sheet guide 45 is disposed substantially below the pressure roller 44. The sheet guide 45 guides the recording medium P being conveyed to the fixing nip. A portion of the sheet guide 45 is bent upward, parallel to the direction of arrow A, forming a contact portion 45*a*.

The pressure roller 44 can move laterally left and right as indicated by the double-headed arrow B. As the pressure roller 44 moves, the cam mechanism 50 serving as a pressure adjusting mechanism moves the sheet guide 45 laterally as well, in conjunction with the pressure roller 44 as indicated by a double-headed arrow C, thereby reliably conveying the recording medium. It is to be noted that in FIGS. 2A and 2B the position of the sheet guide 45 after its move is indicated by a broken line, as is the position of the pressure roller 44 after its move.

Figure 3:
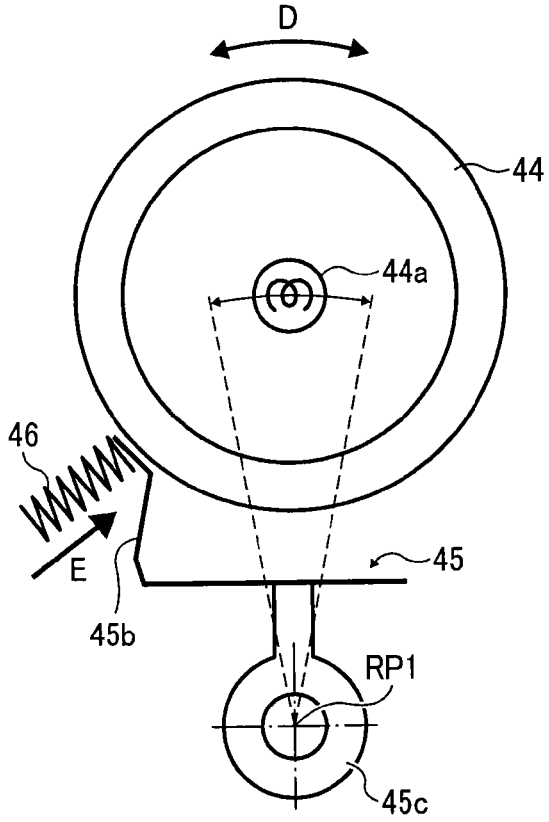
FIG. 3 is a schematic cross-sectional diagram illustrating a pressure roller, a sheet guide, a coil spring, and a center of rotation of the pressure roller and the sheet guide of the fixing device according to an illustrative embodiment of the present invention.
Figure 4:
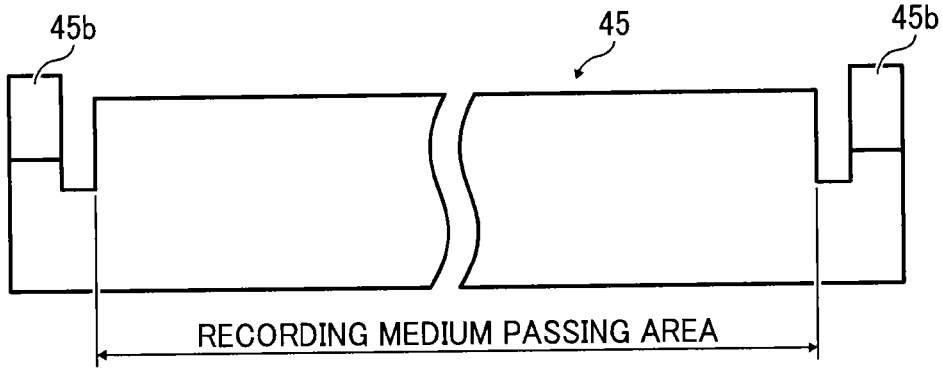
FIG. 4 is a partially enlarged schematic diagram as viewed along arrow D in FIG. 3, illustrating relative positions of contact portions and a recording medium passing area of the sheet guide where a recording medium passes.

With reference to FIGS. 3 and 4, a description will be provided of the pressure roller 44 and the sheet guide 45 according to another illustrative embodiment. FIG. 3 is a schematic cross-sectional diagram illustrating the pressure roller 44, the sheet guide 45, and a coil spring 46 serving as a biasing member, and a center of rotation of the pressure roller 44 and the sheet guide 45. FIG. 4 is a partially enlarged schematic diagram as viewed from a direction of arrow D in FIG. 3, illustrating a relative position of contact portions 45*b* and a recording medium passing area of the sheet guide 45 where the recording medium P passes. Each of the contact portions 45*b* is disposed at both ends of the sheet guide 45 and supported by the coil spring 46.

As illustrated in FIG. 3, one end of the coil spring 46 is fixedly disposed substantially at the lower left of the pressure roller 44. The other end of the coil spring 46 contacts and supports the contact portion 45*b*. The spring 46 urges the contact portion 45*b* in the direction of arrow E to maintain a constant gap between the leading end of the sheet guide downstream in the conveyance direction of the recording medium and the pressure member.

The contact portion 45*b* is formed such that a portion of both ends of the sheet guide 45 is bent in an angular shape or a substantially "dogleg" shape. However, the shape of the contact portion 45*b* is not limited to this. As long as the contact portion 45*b* can contact the pressure roller 44, a similar, if not the same effect, may be achieved.

Because the coil spring 46 contacts each of the contact portions 45*b* of the sheet guide 45, the pressure roller 44 is pressed by the contact portions 45*b* outside the recording medium passing area as illustrated in FIG. 4. It is to be noted that the same gap is maintained always between the contact portions 45*b* and the pressure member 44. That is, the front end portion of the sheet guide 45 is spaced a certain distance relative to the pressure member 44, and the distance does not change.

FIG. 4 illustrates a relative position of the recording medium passing area and the contact portions 45*b* in the plane direction of the recording medium. As can be seen in FIG. 4, the contact portions 45*b* are each provided at both ends of the recording medium passing area.

Figure 5:
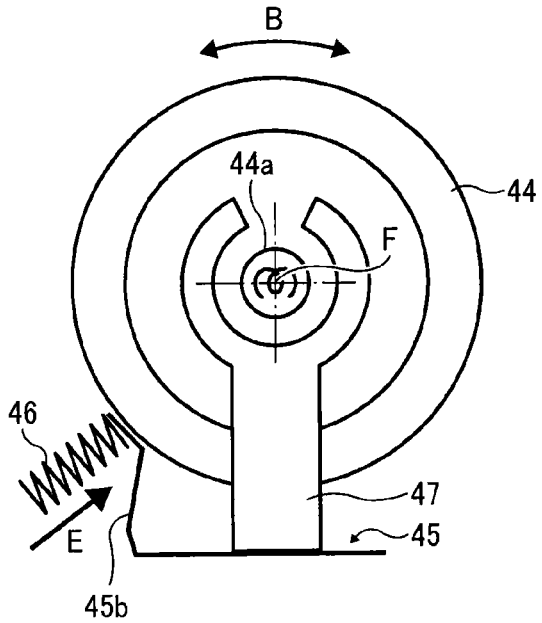
FIG. 5 is a schematic cross-sectional diagram illustrating the sheet guide on which a shaft bearing retainer is disposed upright.
Figure 6:
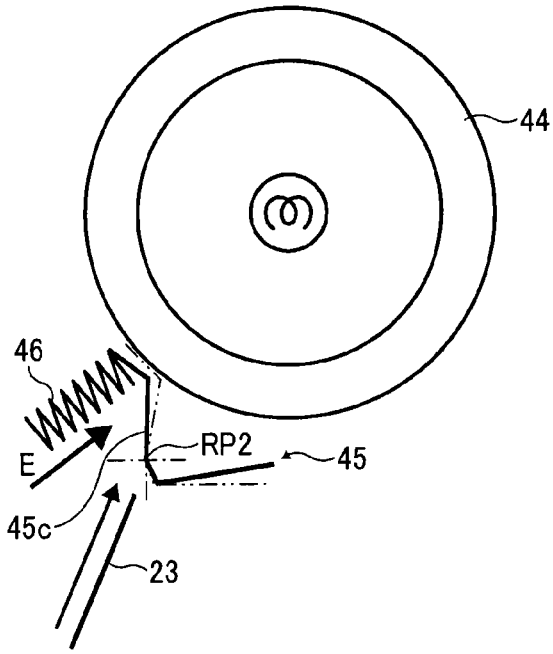
FIG. 6 is a schematic cross-sectional diagram illustrating the sheet guide rotatable about a position substantially near a sheet receiving portion.
Figure 7:
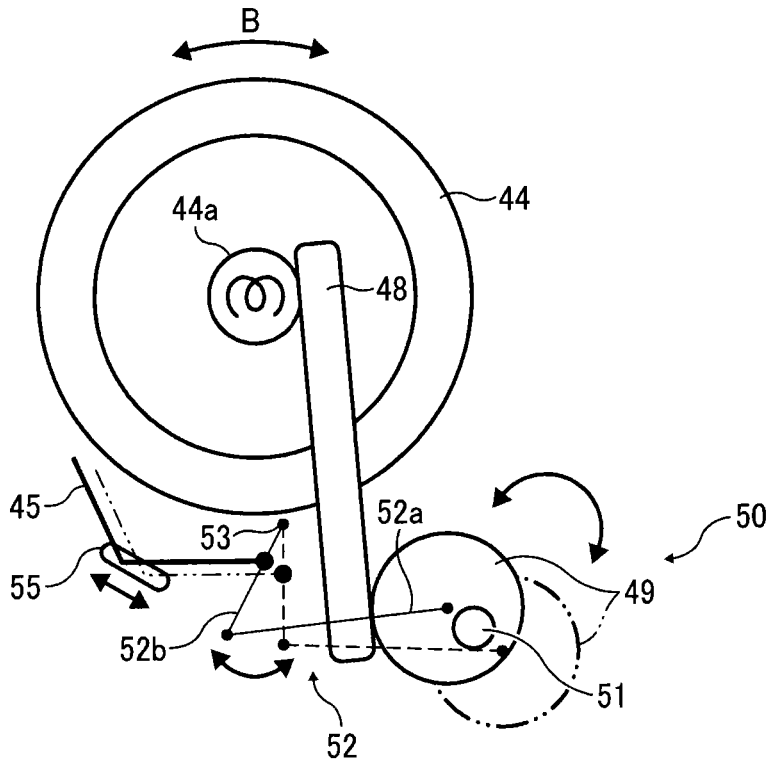
FIG. 7 is a schematic cross-sectional diagram illustrating a pressure-adjusting cam mechanism according to the illustrative embodiment.

It is to be noted that the relative position of the recording medium passing area and the contact portion 45*a* illustrated in FIG. 2 is substantially the same in FIGS. 5 through 7.

Referring back to FIG. 3, the pressure roller 44 and the sheet guide 45 are swingable about a center of rotation RP1 centered on a support member 45*c* that swingably supports the sheet guide 45. Accordingly, the sheet guide 45 can swingably move about the center of rotation RP1 in conjunction with the pressure roller 44 which also swingably moves about the center of rotation RP1 in the direction of arrow D.

As can be seen in FIG. 3, the pressure roller 44 swingably moves in a circular arc as indicated by the arrow D. The center of rotation of the sheet guide 45 coincides with the center of the circular arc. That is, the sheet guide 45 is held coaxially with the center of the circular arc of the pressing member 44, thereby moving stably in conjunction with the pressure roller 44. This configuration allows for stable and reliable conveyance of the recording medium without changing the relative position and an angle between the sheet guide 45 and the pressure roller 44.

With reference to FIG. 5, a description is now provided of another example of the pressure roller 44 and the sheet guide 45 moving in conjunction with the pressure roller 44 according to still another illustrative embodiment. FIG. 5 is a schematic cross-sectional diagram illustrating the sheet guide 45 on which a shaft bearing retainer 47 is disposed upright.

The shaft bearing retainer 47 retains a shaft bearing of the shaft of the pressure roller 44, not illustrated. It is to be noted that a reference letter F refers to the axial center of the pressure roller 44 as well as a center of a holding position of the sheet guide 45.

As illustrated in FIG. 5, the shaft bearing retainer 47, which supports the shaft bearing of the shaft of the pressure roller 44, not illustrated, is disposed substantially on the upper surface of the sheet guide 45 so as to surround the shaft bearing of the pressure roller 44, and swingably moves about the axial center F. In other words, the sheet guide 45, which is fixed to the shaft bearing retainer 47, is held at the axial center F of the pressure roller 44 so that the sheet guide 45 can swingably move about the axial center F as the shaft bearing retainer 47 moves.

With this configuration, the sheet guide 45 can move reliably in conjunction with movement of the pressure roller 44.

With reference to FIG. 6, a description will be provided of another example of the pressure roller 44 and the sheet guide 45 moving in conjunction with the pressure roller 44 according to still another illustrative embodiment. FIG. 6 is a schematic cross-sectional diagram illustrating the pressure roller 44 and the sheet guide 45 rotatable about a position at which the recording medium P is discharged from the transfer device 20.

As illustrated in FIG. 6, a second sheet guide 23 is provided substantially near the position at which the recording medium P is discharged from the transfer device 20 and guides the recording medium P reliably to a proper position as the recording medium P exits from the transfer device 20. The position at which the recording medium P is discharged from the second sheet guide 23 is always the same. According to the present embodiment, a rotation center retainer, not illustrated, is provided to, for example, a side wall of the fixing device 40, to rotatably hold the sheet guide 45 about a center of rotation RP2.

In other words, the sheet guide 45 is rotatable about a position at which the sheet guide 45 receives the recording medium from the transfer device 20 at the upstream of the direction of conveyance. It is to be noted that the position of the sheet guide 45 after its move is indicated by a broken line in FIG. 6.

With this configuration, even when the sheet guide 45 rotates, the conveyance position of the recording medium P remains unchanged relative to the pressure roller 44. Furthermore, the position at which the sheet guide 45 receives the recording medium P from the second sheet guide 23 remains also unchanged, that is, the sheet guide 45 receives the recording medium P substantially near the rotation center thereof, thereby conveying reliably the recording medium P.

With reference to FIG. 7, a description is provided of an example of the pressure adjusting mechanism that changes an amount of engagement of the pressure member 44 against the fixing roller 43, according to the illustrative embodiment. FIG. 7 is a schematic cross-sectional diagram illustrating the pressure-adjusting cam mechanism 50 serving as an example of the pressure adjusting mechanism of the pressure roller 44.

According to the present embodiment, the pressure adjusting mechanism enables the sheet guide 45 to move in conjunction with the pressure roller 44 as the pressure roller 44 moves. As illustrated in FIG. 7, the cam mechanism 50 serving as the pressure adjusting mechanism includes a pressing lever 48, a pressure adjusting cam 49, a rotary shaft 51, and a link mechanism 52. A substantially upper left surface of the pressing lever 48 contacts the shaft bearing that supports the pressure roller 44. The pressure adjusting cam 49 is disposed at the lower right surface of the pressing lever 48. The pressure adjusting cam 49 rotates eccentrically about the rotary shaft 51. As the pressure adjusting cam 49 rotates, the pressure adjusting cam 49 contacts the lower right surface of the pressing lever 48, causing the pressing lever 48 to translate in the direction of arrow B.

The right end portion of a first lever 52*a* of the link mechanism 52 is rotatably supported by the pressure adjusting cam 49. The other end of the first lever 52*a*, that is, the left end portion thereof, is rotatably supported by the lower end of a second lever 52*b*. The upper end portion of the second lever 52*b* is rotatably supported by a shaft 53. The sheet guide 45 is rotatably supported by the second lever 52*b*.

It is to be noted that in FIG. 7 movement of the sheet guide 45 is indicated by a broken line. Movement of the link mechanism 52 is indicated by a dotted line. Movement of the pressure adjusting cam 49 is indicated by a broken line.

With the configuration as described above, rotation of the pressure adjusting cam 49 enables the sheet guide 45 to slidably move along a guide slot 55 provided in the side plate of the fixing device 40, for example. Accordingly, the sheet guide 45 can move along the guide slot 55 in conjunction with the pressure roller 44 as the pressure roller 44 changes its amount of engagement relative to the fixing roller 43 in accordance with types and thicknesses of the recording medium. Furthermore, this configuration can change an angle of the recording medium advancing to the fixing nip and the gap between the pressure roller 44 and the sheet guide 45 in accordance with the types and thicknesses of the recording medium P. Accordingly, the recording medium can be conveyed reliably regardless of the type and thickness of the recording medium.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device, comprising:

a fixing member to heat an unfixed toner image on a recording medium;

a pressure member disposed opposite the fixing member, to press against the fixing member to define a fixing nip through which the recording medium bearing the unfixed toner image passes to fix the unfixed toner image onto the recording medium, the position of the fixing nip being changeable;

a sheet guide disposed adjacent to the pressure member to guide the recording medium to the fixing nip and move in conjunction with movement of the pressure member; and a pressure adjusting mechanism operatively connected to the pressure member to adjust an amount of engagement of the pressure member relative to the fixing member, wherein the sheet guide includes a contact portion to contact the pressure member outside an area where the recording medium passes and a biasing member to press against the contact portion and bias the contact portion against the pressure member, to maintain a constant gap between the leading end of the sheet guide downstream of the conveyance direction of the recording medium and the pressure member.

2. The fixing device according to claim 1, wherein the sheet guide and the pressure member rotate coaxially about an axis of rotation of the pressure member.

3. An image forming apparatus, comprising:

a fixing device according to claim 1;

an image bearing member to bear an electrostatic latent image on a surface thereof;

a developing device to develop the electrostatic latent image formed on the image bearing member using toner to form a toner image; and a transfer device to transfer the toner image on the recording medium, wherein the fixing device fixes the toner image on the recording medium.

4. The image forming apparatus according to claim 3, wherein the sheet guide and the pressure member rotate coaxially about an axis of rotation of the pressure member.

5. A fixing device, comprising:

a fixing member to heat an unfixed toner image on a recording medium;

a pressure member disposed opposite the fixing member, to press against the fixing member to define a fixing nip through which the recording medium bearing the unfixed toner image passes to fix the unfixed toner image onto the recording medium, the position of the fixing nip being changeable;

a sheet guide disposed adjacent to the pressure member to guide the recording medium to the fixing nip and move in conjunction with movement of the pressure member; and a pressure adjusting mechanism operatively connected to the pressure member to adjust an amount of engagement of the pressure member relative to the fixing member, wherein:

the sheet guide further comprises a guide support member supporting the sheet guide, both the pressure member and the sheet guide move in a same circular arc when the pressure adjusting mechanism adjusts the pressure of the pressure member against the fixing member, and the circular arc is centered on the guide support member.

6. The fixing device according to claim 5, wherein the sheet guide and the pressure member rotate coaxially about an axis of rotation of the pressure member.

7. An image forming apparatus, comprising:

a fixing device according to claim 5;

an image bearing member to bear an electrostatic latent image on a surface thereof;

a developing device to develop the electrostatic latent image formed on the image bearing member using toner to form a toner image; and a transfer device to transfer the toner image on the recording medium, wherein the fixing device fixes the toner image on the recording medium.

8. The image forming apparatus according to claim 7, wherein the sheet guide and the pressure member rotate coaxially about an axis of rotation of the pressure member.

9. A fixing device, comprising:

a fixing member to heat an unfixed toner image on a recording medium;

a pressure member disposed opposite the fixing member, to press against the fixing member to define a fixing nip through which the recording medium bearing the unfixed toner image passes to fix the unfixed toner image onto the recording medium, the position of the fixing nip being changeable;

a sheet guide disposed adjacent to the pressure member to guide the recording medium to the fixing nip and move in conjunction with movement of the pressure member; and a pressure adjusting mechanism operatively connected to the pressure member to adjust an amount of engagement of the pressure member relative to the fixing member, wherein the sheet guide is rotatable about a position at which the sheet guide receives the recording medium upstream from the pressure member in the direction of conveyance of the recording medium.

10. An image forming apparatus, comprising:

a fixing device according to claim 9;

an image bearing member to bear an electrostatic latent image on a surface thereof;

a developing device to develop the electrostatic latent image formed on the image bearing member using toner to form a toner image; and a transfer device to transfer the toner image on the recording medium, wherein the fixing device fixes the toner image on the recording medium.

* * * * *